US009702650B1

(12) United States Patent
Carson et al.

(10) Patent No.: US 9,702,650 B1
(45) Date of Patent: Jul. 11, 2017

(54) WEAPON BLAST ATTENUATION

(71) Applicants: Robert Carson, Watervliet, NY (US); Eric L. Kathe, Ballston Lake, NY (US); Robert E. Dillon, Latham, NY (US)

(72) Inventors: Robert Carson, Watervliet, NY (US); Eric L. Kathe, Ballston Lake, NY (US); Robert E. Dillon, Latham, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 176 days.

(21) Appl. No.: 14/080,827

(22) Filed: Nov. 15, 2013

Related U.S. Application Data

(60) Provisional application No. 61/726,709, filed on Nov. 15, 2012.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/16; F41A 21/26; F41A 21/482; F41A 13/06; F41A 21/00; F41A 21/28; F41A 21/36; F41A 11/02; F41A 1/06; F41A 21/18; F41A 21/24; F41A 11/06; F41A 13/08; F41A 21/488; F41A 25/00; F41A 9/55; F41A 21/34; F41A 25/02; F42B 5/10; F42B 5/145; F41B 11/60
USPC ..... 89/14.4, 14.05, 37.05; 181/233–234
See application file for complete search history.

(56) References Cited

U.S. PATENT DOCUMENTS 14,597 A * 4/1856 Buchel ..... F41A 21/16 42/76.01
45,898 A * 1/1865 Berdan ..... F41A 21/18 102/376
1,258,188 A * 3/1918 Cleveland ..... C21D 7/12 89/14.7
1,419,845 A * 6/1922 Guy ..... B21C 37/152 89/14.7
1,667,186 A * 4/1928 Bluehdorn ..... F41A 21/30 181/223
2,378,735 A * 6/1945 Shaffer ..... F42B 27/08 102/483
3,100,358 A * 8/1963 Robinson, Jr. ..... F41A 21/18 42/78
3,229,583 A * 1/1966 Long ..... F41A 21/16 102/517
3,284,942 A * 11/1966 Moseley ..... F41A 21/40 42/76.01

(Continued)

*Primary Examiner* — Troy Chambers
*Assistant Examiner* — Bridget Cochran
(74) *Attorney, Agent, or Firm* — John P. DiScala

(57) ABSTRACT

A method to attenuate the blast wave/blast overpressure from a weapon discharge by leaking an effective quantity of propellant gas from behind the projectile, into the precursor gas flow in front of the projectile, while the projectile is still in the weapon barrel—whereby the exit pressure ratio of the projectile from the weapon is surprisingly reduced by about 95%—resulting in a reduction of from about 51.6 to about 58.2% in the peak pressure level/sound wave which impacts the user or crew of the weapon.

3 Claims, 2 Drawing Sheets

(56) References Cited

U.S. PATENT DOCUMENTS 3,611,867 A * 10/1971 Silsby ..... F41A 21/28 42/105
4,426,909 A * 1/1984 Carter ..... F41A 21/30 89/1.816
4,527,348 A * 7/1985 Brennan ..... F41A 21/16 42/76.01
4,590,698 A * 5/1986 Finn ..... F41A 21/28 42/76.01
4,646,615 A * 3/1987 Gladstone ..... B29C 53/805 42/76.02
4,649,798 A * 3/1987 Phillips ..... F41A 21/30 181/223
4,712,465 A * 12/1987 Macdonald ..... F41A 21/18 102/372
4,722,261 A * 2/1988 Titus ..... F41A 1/04 60/769
5,355,765 A * 10/1994 Rogers ..... F41A 13/12 89/14.4
5,703,322 A * 12/1997 Tidman ..... C06B 47/02 102/430
5,798,473 A * 8/1998 Roblyer ..... F41A 21/28 42/75.01
5,844,162 A * 12/1998 Renner ..... F41A 21/18 42/51
6,575,266 B1 * 6/2003 Gehse ..... F41A 21/36 181/223
6,739,083 B2 * 5/2004 Martin ..... F41A 21/16 42/78
6,880,444 B2 * 4/2005 Ang ..... F41A 21/30 89/14.3
8,261,651 B2 * 9/2012 Casas Salva ..... F41A 21/02 181/223
8,826,579 B2 * 9/2014 Lippard ..... B23D 77/14 42/76.1
9,074,834 B1 * 7/2015 Toto ..... F41A 21/30
2003/0037475 A1 * 2/2003 Juan ..... F41A 21/18 42/78
2003/0150320 A1 * 8/2003 Chang ..... F41A 21/16 89/14.05
2004/0129131 A1 * 7/2004 Kazyaka ..... F41A 21/28 89/14.4
2004/0154462 A1 * 8/2004 Ang ..... F41A 21/30 89/14.2
2005/0257413 A1 * 11/2005 Zimmermann ..... F41A 5/04 42/75.1
2015/0241159 A1 * 8/2015 Michal ..... F41A 21/44 89/14.4

* cited by examiner

WEAPON BLAST ATTENUATION

CROSS REFERENCE TO RELATED APPLICATIONS

This application claims the benefit under 35 USC §119(e) of U.S. provisional patent application U.S. 61/726,709, filed Nov. 15, 2012, which provisional is hereby incorporated by reference herein.

FEDERAL RESEARCH STATEMENT

The inventions described herein may be manufactured, used and licensed by, or for the U.S. Government, for U.S. Government purposes.

BACKGROUND OF INVENTION

Field of the Invention

The present invention relates to a method of attenuating the blast overpressure caused by the escaping gases whenever a projectile exits a weapon tube—which overpressure is known to cause temporary and permanent hearing loss to the weapon's user.

Related Art

Blast overpressure (BOP) is a phenomenon that is encountered when a blast wave is formed due to release of a relatively high amount of energy into the surrounding environment, for example, when a projectile is expelled from the muzzle of a hand gun, a mortar, or a large caliber weapon, such as a howitzer. Such a high energy blast wave is in-part manifested as an impulse of noise, a sound wave—which expands about the rear of the muzzle to impact the weapon's user or crew, causing both temporary and permanent hearing loss.

The ear damage and resulting hearing loss caused by a blast wave/blast overpressure from a weapon discharge is directly related to the peak pressure level of the sound wave experienced by the weapon's user—though other factors, such as sound frequency, energy spectrum, rise time of the sound wave, duration of the sound wave, repetition rate and total number of exposures to the sound wave are all relevant. Peak pressure is defined quantitatively in psi (pounds per square inch) or dB (decibels) above a base or reference level (i.e. the auditory threshold of 0.0002 dynes per square centimeter or 20 μPa). Such hearing damage can result from exposure to a sound pressure level over the auditory threshold of about 85 dB, even if the exposure isn't continuous; which level is significantly below the threshold of pain, which is understood to be about 130 dB. In comparison, the peak sound pressure level, over the 20 μPa auditory threshold for an M16 rifle at the gunner's left ear is about 154 dB, and the corresponding peak sound pressure level for a 105 mm towed howitzer is from about 185 dB.

Various techniques have been attempted to mitigate the BOP effect on the crew serviced military weapons, especially cannons and mortars—where the BOP and sound pressure effects are significantly greater than with a hand weapon. Such techniques include—(1) reducing the propellant—which unfortunately also reduces the range of the weapon; (2) using muzzle devices to cool, expand, diffuse and expel the muzzle gas flow, such as a double baffle sound-suppressor for the M16, which can reduce the peak sound level to about 148 dB (a reduction of 6 dB)—but, which adds weight, cost, and complexity to the weapon; (3) using another type of muzzle device known as a Blast Attenuation Device (BAD), which is commonly used on mortars to funnel and accelerate the blast in the direction of the projectile, i.e. deflecting it away from the motor's crew—but, which again adds weight and adds significant length to the mortar tube (a significant problem for loading longer tube mortars (e.g. 120 mm mortars); especially when such mortars were ground mounted—cases where shorter crew members have to stretch to hang the rounds even without the BAD device's added length).

A large number of investigations have been performed on the propagation of blast wave resulting from a variety of cannon systems. These studies include both experimental and numerical work—including for example, Schmidt et al, "Analysis of Weapon Parameters Controlling the Muzzle Blast Overpressure Field," 5$^{th}$ International Symposium on Ballistics, 1980, where a series of experiments were conducted on a 20 mm cannon to study weapon exhaust properties, near flow-field structure, and the blast overpressure. Schmidt found that it is important to account for the precursor/propellant gas interactions in the description of the near muzzle flowfield. Schmidt developed a closed-form expression for the overpressure around the weapon muzzle that fits with a variety of cannon systems. Similarly, Klingenberg, "Investigation of Combustion Phenomena Associated with the Flow of Hot Propellant Gases—III: Experimental Survey of the Formation and Decay of Muzzle Flowfields and Pressure Measurements," Combustion and Home, Vol. 29, No. 3, 1977, pp. 289-309, also looked into aspects of muzzle blast for a 7.62 mm rifle through shadowgraph examined the muzzle blast field. While providing an increased understanding of the physical events occurring within and about the muzzle blast field and overpressure—these studies did not propose alternative weapon designs versus the current state of the art—to mitigate overpressure and its effects.

In parallel with the experimental work discussed above, various purely numerical studies have also been carried out providing further insight into blast wave structure and propagation. For example, Erdos and Del Guidice, Calculation of Muzzle Blast Flowfields," AIAA Journal, Vol. 13, No. 8, 1975, pp. 1048-1055, disclosed numerical simulations of the unsteady shock layer bounded by the mach disk and blast wave. More recently, numerical studies have been conducted on blast mitigation utilizing a muzzle device; wherein, for example, Kang et al, "A Study on Impulsive Attenuation for High-Pressure Blast Flowfield," Journal of Mechanical Science and Technology, Vol. 22, 2008, pp. 190-200, carried out numerical analysis of high-pressure supersonic blast flowfields and compared the results to several experiments; which results, indicated optimum design considerations for silencers. Additionally, Rehman et al, "Analysis and Attenuation of Impulsive Sound Pressure in a Large Caliber Weapon During Muzzle Blast," Journal of Mechanical Science and Technology, Vol. 25, 2011, pp. 2601-2606, showed blast attenuation on a 120 mm cannon utilizing a three-baffled silencer. However, none of these studies ended provided any alternative weapon designs versus the current state of the art—to mitigate overpressure and its effects.

Thus there is a need in the art for a means to attenuate the blast wave/blast overpressure that results from a weapon discharge, such that the peak pressure level/sound wave which impacts the user or crew of the weapon is significantly reduced, to mitigate the harm caused to the user or crew; and, where the method does not significantly reduce the range of the weapon, add to its weight, or otherwise detract from its serviceability—as does prior art solutions.

SUMMARY OF INVENTION

The present invention addresses the above stated need in the art for a means to attenuate the blast wave/blast overpressure from a weapon discharge by leaking an effective quantity of propellant gas from behind the projectile, into the precursor gas flow in front of the projectile, while the projectile is still in the weapon barrel—whereby the exit pressure ratio of the projectile from the weapon is surprisingly reduced—resulting in a significant reduction in the peak pressure level/sound wave which impacts the user or crew of the weapon. In the present invention, the leakage of propellant gas from behind the projectile into the precursor gas flow in front of the projectile (as the projectile is being fired and is traveling down the weapon's bore) is caused by an increase in the diameter of a length of the weapon bore—which length is sufficient to allow from about 4.5 to about 8 percent of the volume of the total weapon bore volume to leak or travel from the high pressure propellant gas flow, behind the projectile, to and into the lower pressure precursor gas flow in front of the projectile.

Preferably the present invention includes a weapon which has an elongated barrel for firing a projectile of any given caliber, which elongated barrel has a generally cylindrical bore extending longitudinally therethrough, the bore generally having a diameter equal to the caliber of the projectile; the bore having a muzzle end and a breach end; the bore having a front section, which front section extends from the muzzle end along the length of the bore about half the distance thereof to the breach end of the weapon; wherein along at least part of the length of the front section of the bore, at least part of a length of the bore is increased in diameter, such that an effective quantity of propellant gas from behind the projectile can leak around the projectile into the precursor gas flow in front of the projectile; whereby, the peak overpressure caused when a projectile is expelled from the weapon is significantly reduced. In fact, surprisingly, reductions in peak overpressure of from 51.6 to 58.2% were observed with a most preferred embodiment of the present invention, wherein the leakage volume was 7.5% of the volume of the given weapon's total bore volume. Further, the reduction in exit velocity with this most preferred embodiment was less than 5% (or a reduction in range of about 9.5%)—which can be compensated for by simply increasing the propellant change; such that there will be no negative effects associated with the present invention.

In the above summary of the present invention, the increase in diameter of at least part of the length of the front section of the bore, can be a single bulge along the length, or a plurality of bulges, or a set of elongated channels equally spaced apart about the circumference of the bore, which set of elongated channels are most preferably extend along the entire length of the front section of the bore. In the most preferred embodiment of the present invention, there are four (4) equally spaced elongated channels extending along the entire length of the front section of the bore, which channels allow a leakage volume of 7.5% of the volume of the a given weapon's total bore volume.

With respect to the most preferred embodiment of the present invention, as generally described above with four channels to allow a leakage of 7.5% of the volume of the weapon's total bore volume—if one considers a weapon having an arbitrary 1 caliber projectile and corresponding generally 1 caliber bore and 13.5 caliber total bore length—the most preferred embodiment would have about a 6.28 caliber bore circumference, the four channels would be about 0.7 calibers in width separated by about 0.87 caliber sections of bore, the channels would be about 0.041 calibers in height (depth of cut into the bore material), and the channel length along the entire length of the front section of the bore would be about 6.7 calibers. So, to establish the most preferred dimensions of the present invention for any caliber projectile/weapon, these 1 caliber dimensions would simply be scaled up.

Further features and advantages of the present invention will be set forth in, or apparent from, the drawings and detailed description of preferred embodiments thereof which follows.

BRIEF DESCRIPTION OF THE DRAWING

A more complete understanding of the present invention disclosure may be realized by reference to the accompanying drawings in which:

FIG. 2 is a weapon tube, having a length of 13.5 calibers and a diameter of 1 caliber—wherein FIG. 2 shows the 8 positions in relation to the weapon muzzle (top view) at which results were taken for comparison.

DETAILED DESCRIPTION

As detailed above, the present invention provides a means to attenuate the blast wave/blast overpressure from a weapon discharge by leaking an effective quantity of propellant gas from behind the projectile, into the precursor gas flow in front of the projectile, while the projectile is still in the weapon barrel—such that the peak pressure level/sound wave which impacts the user or crew of the weapon is significantly reduced, an effect created by the augmentation of the exit pressure ratio (i.e. the pressure immediately behind the projectile at the muzzle divided by the pressure immediately outside of the muzzle). This leakage of high pressure propellant gas into the precursor gas flow in front of the projectile makes the precursor gas flow significantly more robust; such that, the main blast energy will exit into a modified atmosphere about the muzzle region where the exit pressure is significantly higher than an unmodified barrel. More specifically, and surprisingly, the exit pressure ratio will be reduced by about 95%—i.e. from an exit pressure of about the order of magnitude of 13 in a mortar containing the present invention vs. of the order of magnitude of about 240 of the same prior art mortar (which does not contain the present invention). Therefore, the present invention will directly lower the primary blast energy that propagates as a sound wave rearward toward the weapon's user or crew (located toward the breach of the weapon) at a reduced peak overpressure.

Figure 1:
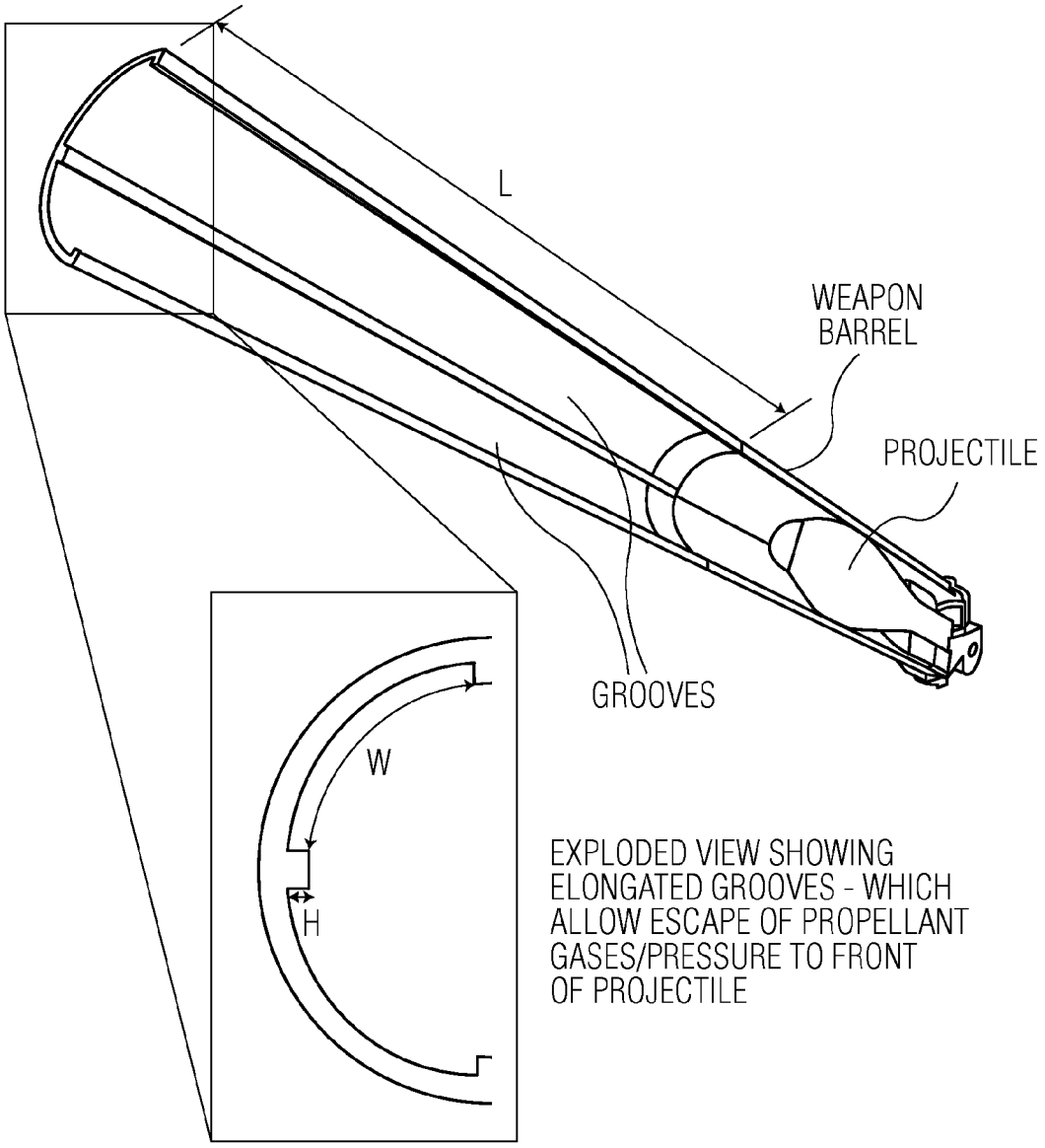
FIG. 1 is a sectioned schematic diagram of a weapon barrel, showing an embodiment of the present invention, wherein within the weapon barrel is a projectile at the breach end thereof, and elongated channels cut into the bore within the barrel, extending along the front or muzzle section of the barrel to the muzzle itself—which channels will allow leakage of propellant gas from behind the projectile, into the precursor gas flow in front of the projectile.

A preferred embodiment of the present invention is shown in FIG. 1 (not drawn to scale), wherein a schematic sectioned view of a typical weapon barrel is shown, with a projectile shown at the breach end thereof. The sectioned view shows the interior of the barrel with two grooves or channels, located from about the midpoint of the weapon barrel to the muzzle end thereof. As shown in FIG. 1 and the accompanying exploded view of the muzzle end thereof—the grooves have a length of L, a width of W, and a height (or depth) of H. Further, as the sectioned view of FIG. 1 is ½ of the barrel—the completed preferred embodiment has 4 elongated grooves or channels.

Alternative embodiments of the present invention can have from the 4 channels as shown in FIG. 1, to 16 channels—the length, width, and height dimensions of which channels and related leakage volume of propellant gas from behind to in-front of the projectile can vary as shown in Table 1, below. The alternative embodiments of the present invention shown in Table 1, i.e. preferred geometric configurations are all in terms of a 1 caliber projectile and a 13.5 caliber barrel/bore length (such that it is easy to scale alternative embodiments for manufacture by a simple proportioning—to the particular caliber of projectile and barrel/bore length desired).

TABLE 1

Summary of preferred geometric configurations of the present invention (in all cases tube length is 13.5 calibers and diameter is 1 caliber)

| Alternative Embodiment | Leak Volume (V) (%) | Number of Channels (N) | Channel Length (L) (Cals) | Channel Height (H) (Cals) | Channel Width (W) (Cals) |
|---|---|---|---|---|---|
| CLM-(7.5)(4)(6.7) | 7.5 | 4 | 6.7 | 0.041 | 0.70 |
| CLM-(6.6)(8)(6.7) | 6.6 | 8 | 6.7 | 0.041 | 0.31 |
| CLM-(5.7)(12)(6.7) | 5.7 | 12 | 6.7 | 0.041 | 0.17 |
| CLM-(4.8)(16)(6.7) | 4.8 | 16 | 6.7 | 0.041 | 0.11 |
| CLM-(7.5)(8)(6.7) | 7.5 | 8 | 6.7 | 0.046 | 0.31 |
| CLM-(7.5)(12)(6.7) | 7.5 | 12 | 6.7 | 0.054 | 0.17 |
| CLM-(7.5)(16)(6.7) | 7.5 | 16 | 6.7 | 0.064 | 0.11 |
| CLM-(7.5)(4)(5.4) | 7.5 | 4 | 5.4 | 0.050 | 0.70 |
| CLM-(6.6)(8)(5.4) | 7.5 | 8 | 5.4 | 0.057 | 0.31 |
| CLM-(6.6)(12)(5.4) | 7.5 | 12 | 5.4 | 0.065 | 0.17 |
| CLM-(6.6)(16)(5.4) | 7.5 | 16 | 5.4 | 0.078 | 0.11 |

The alternative embodiments shown in Table 1 are designated Channel Leak Method (CLM) followed by, in parenthesis, the leak volume (in % of the volume of the total weapon bore), number of channels/grooves (in calibers, based upon a 1 caliber projectile), and the length of the channels/grooves (in calibers—based again on a 1 caliber projectile and a 13.5 caliber length weapon tube or bore).

Figure 2:
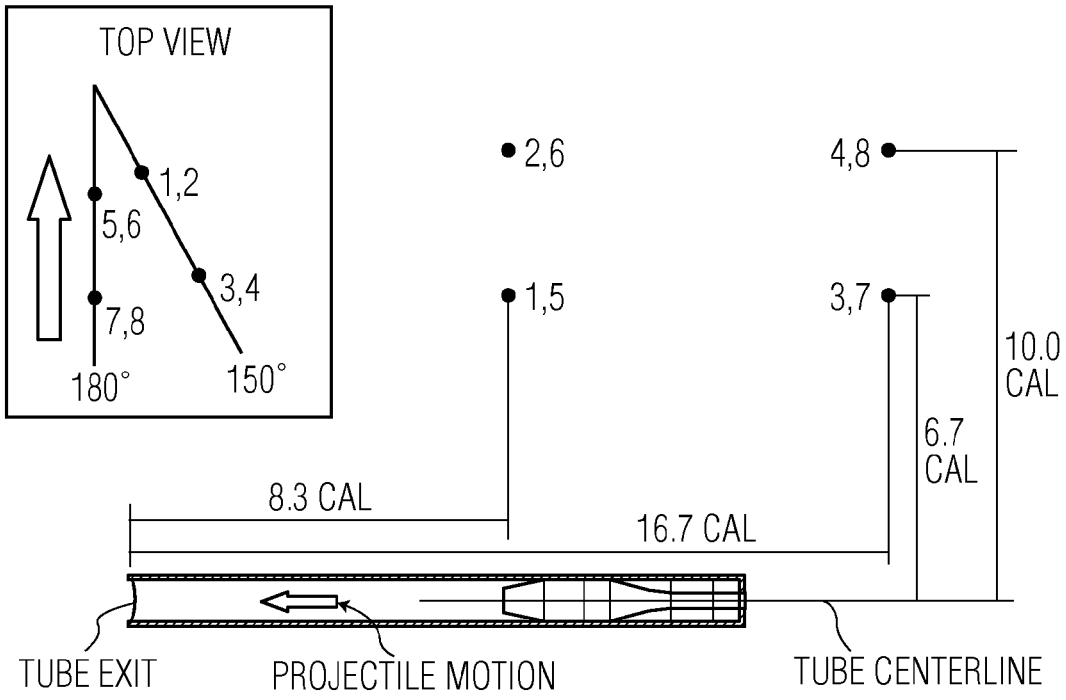

As shown in FIG. 2 and reproduced in Table II, below, a series of pressure measurements where made at positions 1-8 with respect to the weapon muzzle (5 rounds fired at each position)—using series of weapons having the alternative embodiment configurations of the present invention shown in Table 1.

TABLE II

Locations of the rearward monitored positions

| Position | Azimuthal Angle (degrees) | Distance from Muzzle (calibers) | Height above Tube Centerline (calibers) |
|---|---|---|---|
| 1 | 150 | 8.3 | 6.7 |
| 2 | 150 | 8.3 | 10.0 |
| 3 | 150 | 16.7 | 6.7 |
| 4 | 150 | 16.7 | 10.0 |
| 5 | 180 | 8.3 | 6.7 |
| 6 | 180 | 8.3 | 10.0 |
| 7 | 180 | 16.7 | 6.7 |
| 8 | 180 | 16.7 | 10.0 |

Shown in Table III, below, for positions 1-8 of FIG. 3/Table II, are the observed percentage decrease in peak overpressure compared to a normal cylindrical weapon tube (with the normal nil leakage of the propellant gas from behind to in-front of the projectile)—having a 13.5 caliber length and a 1 caliber diameter (all using the same propellant and quantity thereof).

TABLE III

Percent decrease in peak overpressure compared to the baseline for varied leak volumes

| | CLM-(7.5)(4)(6.7) | CLM-(6.6)(8)(6.7) | CLM-(5.7)(12)(6.7) | CLM-(4.8)(16)(6.7) |
|---|---|---|---|---|
| Pos 1 | 54.6% | 45.8% | 30.1% | 11.8% |
| Pos 2 | 55.1% | 44.9% | 19.3% | 11.9% |
| Pos 3 | 52.7% | 46.1% | 26.2% | 12.9% |
| Pos 4 | 51.6% | 41.9% | 2.9% | 4.3% |
| Pos 5 | 54.1% | 40.0% | 22.6% | −18.4% |
| Pos 6 | 58.2% | 38.1% | 28.3% | −17.0% |
| Pos 7 | 53.8% | 34.1% | 36.3% | 9.3% |
| Pos 8 | 57.2% | 48.4% | 40.7% | −8.0% |

Clearly, and surprisingly, the embodiment having a the leak volume of 7.5 (in % of the volume of the total weapon bore), number of channels/grooves of 4 (in calibers, based upon a 1 caliber projectile), and the length of the channels/grooves being 6.7 (in calibers—based again on a 1 caliber projectile and a 13.5 caliber length weapon tube or bore).

Although the invention has been described above in relation to preferred embodiments thereof, it will be understood by those skilled in the art that variations and modifications can be effected in these preferred embodiments without departing from the scope and spirit of the invention as claimed below.

What is claimed is:

1. A method of attenuating the blast wave/blast overpressure from a weapon discharge comprising: providing a weapon having an elongated barrel with a bore longitudinally therethrough, and a projectile therein; wherein the bore has a muzzle end, a breech end, a front section, said front section extending from the muzzle end along the length of the bore about half the distance thereof to the breech end; increasing the diameter of a length of the front section of the bore wherein the length of bore that is increased in diameter comprises a set of four elongated channels, each channel having a uniform height which are equally spaced apart about the circumference of the bore and extend solely along the entire length of the front section, such that a quantity of high pressure gas from behind the projectile will leak into a precursor gas flow in front of the projectile, as the projectile travels down the barrel without substantially reducing the range of the weapon and wherein the ratio of projectile diameter to total length of barrel is approximately 13.5, the ratio of projectile diameter to bore circumference is about 6.28, the ratio of projectile diameter to channel width is approximately 0.7, the ratio of the projectile diameter to the width between channels is approximately 0.87, the ratio of projectile diameter to channel height is approximately 0.041 and the ratio of projectile diameter to channel length is approximately 67; whereby the exit pressure peak pressure is reduced by about 95%, resulting in a significantly reduced pressure level/sound wave impacting the user or crew of the weapon.

2. The method of attenuating the blast wave/blast overpressure from a weapon discharge of claim 1, wherein the sufficient quantity of high pressure gas which leaks from behind the projectile into the precursor gas flow in front thereof is from about 4.5 to about 8 percent of the volume of the total weapon bore volume.

3. A method of attenuating the blast wave/blast overpressure from a weapon discharge of claim 1, wherein the peak overpressure is reduced from about 51.6 to about 58.2%.

* * * * *